US007970333B2

(12) United States Patent
Anderson et al.

(10) Patent No.: US 7,970,333 B2
(45) Date of Patent: Jun. 28, 2011

(54) SYSTEM AND METHOD FOR PROTECTING AN IMAGE ON A SUBSTRATE

(75) Inventors: Christine D. Anderson, Hamilton (CA); T. Brian Mcaneney, Burlington (CA); Christopher A. Wagner, Etobicoke (CA); Edward G. Zwartz, Mississauga (CA); Stephan V. Drappel, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 426 days.

(21) Appl. No.: 12/179,249

(22) Filed: Jul. 24, 2008

(65) Prior Publication Data

US 2010/0021217 A1 Jan. 28, 2010

(51) Int. Cl.
*G03G 15/20* (2006.01)

(52) U.S. Cl. ..... 399/341; 399/342

(58) Field of Classification Search ..... 399/341, 399/342

See application file for complete search history.

(56) References Cited

U.S. PATENT DOCUMENTS

| | | | | |
|---|---|---|---|---|
| 3,590,000 | A | | 6/1971 | Palermiti et al. |
| 4,070,262 | A | | 1/1978 | Guarino et al. |
| 4,071,425 | A | | 1/1978 | Guarino et al. |
| 4,072,592 | A | | 2/1978 | Due et al. |
| 4,072,770 | A | | 2/1978 | Ting |
| 4,133,909 | A | | 1/1979 | Spencer |
| 4,265,976 | A | | 5/1981 | Nowak |
| 4,265,990 | A | | 5/1981 | Stolka et al. |
| 4,558,108 | A | | 12/1985 | Alexandru et al. |
| 4,563,408 | A | | 1/1986 | Lin et al. |
| 4,584,253 | A | | 4/1986 | Lin et al. |
| 4,585,884 | A | | 4/1986 | Lin et al. |
| 5,162,389 | A | | 11/1992 | Lee et al. |
| 5,219,641 | A | | 6/1993 | Mehta et al. |
| 5,223,368 | A | | 6/1993 | Ciccarelli et al. |
| 5,227,460 | A | | 7/1993 | Mahabadi et al. |
| 5,278,020 | A | | 1/1994 | Grushkin et al. |
| 5,290,654 | A | | 3/1994 | Sacripante et al. |
| 5,308,734 | A | | 5/1994 | Sacripante et al. |
| 5,339,146 | A | * | 8/1994 | Aslam et al. ..... 430/47.5 |
| 5,344,738 | A | | 9/1994 | Kmiecik-Lawrynowicz et al. |
| 5,346,795 | A | | 9/1994 | Pickering et al. |
| 5,346,797 | A | | 9/1994 | Kmiecik-Lawrynowicz et al. |
| 5,348,832 | A | | 9/1994 | Sacripante et al. |
| 5,364,729 | A | | 11/1994 | Kmiecik-Lawrynowicz et al. |
| 5,366,840 | A | | 11/1994 | Larson et al. |
| 5,366,841 | A | | 11/1994 | Patel et al. |
| 5,370,963 | A | | 12/1994 | Patel et al. |
| 5,403,693 | A | | 4/1995 | Patel et al. |
| 5,405,728 | A | | 4/1995 | Hopper et al. |
| 5,418,108 | A | | 5/1995 | Kmiecik-Lawrynowicz et al. |
| 5,496,676 | A | | 3/1996 | Croucher et al. |
| 5,501,935 | A | | 3/1996 | Patel et al. |
| 5,510,220 | A | | 4/1996 | Nash et al. |

(Continued)

*Primary Examiner* — David M Gray
*Assistant Examiner* — G. M. Hyder
(74) *Attorney, Agent, or Firm* — Oliff & Berridge, PLC

(57) ABSTRACT

A system and a method to protect an image on a substrate. The method includes forming an unfused toner image, partially fusing the unfused toner image at a first temperature by exposing the composition to radiation to prevent disruption of the image upon application of the wax-hybrid composition to form a partially fused toner image, cooling the partially fused toner image to a second temperature, providing a protective coating composition comprising a wax-hybrid, applying the protective coating composition over the partially fused toner image, permanently fixing the protective coating composition and partially fused toner image to form a final printed image.

19 Claims, 3 Drawing Sheets

U.S. PATENT DOCUMENTS

| | | | | |
|---|---|---|---|---|
| 5,527,658 | A | 6/1996 | Hopper et al. | |
| 5,585,215 | A | 12/1996 | Ong et al. | |
| 5,627,002 | A | 5/1997 | Pan et al. | |
| 5,650,255 | A | 7/1997 | Ng et al. | |
| 5,650,256 | A | 7/1997 | Veregin et al. | |
| 5,723,253 | A | 3/1998 | Higashino et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,800,884 | A | 9/1998 | D'Anna et al. | |
| 5,804,349 | A | 9/1998 | Ong et al. | |
| 5,826,147 | A | 10/1998 | Liu et al. | |
| 5,827,633 | A | 10/1998 | Ong et al. | |
| 5,840,462 | A | 11/1998 | Foucher et al. | |
| 5,853,944 | A | 12/1998 | Foucher et al. | |
| 5,858,601 | A | 1/1999 | Ong et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,966,570 | A | 10/1999 | Till et al. | |
| 5,977,210 | A | 11/1999 | Patel et al. | |
| 6,177,221 | B1 | 1/2001 | Maniar et al. | |
| 6,180,308 | B1 | 1/2001 | Pan et al. | |
| 6,187,499 | B1 | 2/2001 | Zhao et al. | |
| 6,212,347 | B1 | 4/2001 | Zhao et al. | |
| 6,319,647 | B1 | 11/2001 | Gutman et al. | |
| 6,365,316 | B1 | 4/2002 | Stamp et al. | |
| 6,416,916 | B1 | 7/2002 | Silence et al. | |
| 6,733,878 | B2 | 5/2004 | Timmons et al. | |
| 6,808,815 | B2 | 10/2004 | Kaplan et al. | |
| 7,198,875 | B2 | 4/2007 | Gervasi et al. | |
| 2003/0007814 | A1* | 1/2003 | Richards | 399/341 |
| 2005/0287372 | A1* | 12/2005 | Gervasi et al. | 428/421 |
| 2006/0115306 | A1* | 6/2006 | Lofthus et al. | 399/341 |
| 2007/0053731 | A1* | 3/2007 | Mori et al. | 399/341 |
| 2007/0147917 | A1* | 6/2007 | Chigono et al. | 399/341 |
| 2007/0282037 | A1 | 12/2007 | Anderson et al. | |
| 2008/0025774 | A1* | 1/2008 | Ishibashi et al. | 399/341 |
| 2008/0056785 | A1* | 3/2008 | Maruyama et al. | 399/342 |

* cited by examiner

SYSTEM AND METHOD FOR PROTECTING AN IMAGE ON A SUBSTRATE

TECHNICAL FIELD

This disclosure is directed to a system and a method for forming a robust print. More particularly, in embodiments, this disclosure is directed to a print protection coating that is applied to the surface of a partially fused image. The print protection coating composition is to be applied to the surface of the substrate after forming the image but prior to a final heating step, which completely fixes the image to the substrate. Images protected by the coating composition provide a number of advantages over other electrostatographic prints, such as thermal stability and prevention of document offset.

CROSS-REFERENCE TO RELATED APPLICATIONS

U.S. patent application Ser. No. 11/421,299, filed May 31, 2006, which is herein incorporated by reference in its entirety, is a recording medium with an ink image thereon, wherein a varnish at least partially covers the ink image, and wherein the varnish composition prior to application comprises at least one latex emulsion, water, at least one base and at least one surfactant.

REFERENCES

For forming an image, toners such as conventional mechanically made toners may be used. The processes for the preparation of toner are illustrated in a number of Xerox patents such as, for example, U.S. Pat. Nos. 5,290,654; 5,278,020; 5,308,734; 5,370,963; 5,344,738; 5,403,693; 5,418,108; 5,364,729; 5,346,797; 6,177,221; 6,319,647; 6,365,316; 6,416,916; 5,510,220; 5,227,460; 4,558,108; and 3,590,000. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210; and 5,858,601.

The disclosures of each of the foregoing patents and publications are hereby incorporated by reference herein in their entireties. The appropriate components and process aspects of each of the foregoing patents and publications may also be selected for the present compositions and processes in embodiments thereof. The appropriate components and process parameters of the above Xerox patents may be selected for use in embodiments described herein.

BACKGROUND

Printers, copiers and other types of image forming devices have become necessary productivity tools for producing and/or reproducing documents. Such image forming devices include, but are not limited to: desktop copiers, stand-alone copiers, scanners, facsimile machines, photographic copiers and developers, multi-function devices and other like systems capable of producing and/or reproducing image data from an original document, data file or the like.

In conventional xerography, electrostatic latent images are formed on a xerographic surface by uniformly charging a charge retentive surface, such as a photoreceptor. The charged area is then selectively dissipated in a pattern of activating radiation corresponding to the original image. The latent charge pattern remaining on the surface corresponds to the area not exposed by radiation. Next, the latent charge pattern is visualized by passing the photoreceptor past one or more developer housings comprising toner, which adheres to the charge pattern by electrostatic attraction. The developed image is then transferred to a receiving substrate, such as paper, to which it is fixed by a suitable fusing technique, resulting in a xerographic print or toner-based print.

It is known and customary to apply fuser oil to the fuser roll to provide the necessary release of a substrate from the fuser roll after the conventional toner image has been formed on the substrate. Fuser oils are known to one of ordinary skill in the art and include those disclosed in U.S. Pat. Nos. 7,198,875; 6,808,815; and 6,733,878, each of which is incorporated herein by reference in its entirety. As used herein, "substrate" refers to any output image receiving media that may be printed on, such as paper, pre-printed forms, transparency, cardboard, etc.

Fuser oils, such as non-functionalized or functionalized silicone oils, are useful for providing release of a substrate from a fuser roll found in an imaging device, such as in an electrophotographic device or an electrostatographic device. In such devices, some fuser oil may remain on the toner image, which may cover any portion of the substrate, and on the substrate itself. In other words, the fuser oil may at least partially cover a substrate having no toner image or a substrate having a toner image thereon. As used herein, "partially" refers to the release agent covering from about 1 percent to about 100 percent of the substrate, such as from about 10 percent to about 100 percent or from about 10 percent to about 90 percent of the substrate.

Thus, xerographic prints may include thereon a silicone fuser oil due to the printing process. In the case of amino functionalized fuser oil, the oil may chemically bond to the surface of the print because of hydrogen bonding between the amino component of the oil and the hydroxyl components in the substrate. The surface free energy (SFE) of xerographic prints containing amino functionalized silicone oil may dramatically drop from a range of higher than 30 $mN/m^2$ to a range of from about 8 $mN/m^2$ to about 30 $mN/m^2$.

The presence of a fuser oil on the substrate, with or without a toner image thereon, can thus be detrimental to the ability of an adhesive to adhere to the substrate. Thus, applications such as print-on-demand book making are difficult because residual amino fuser oil resides on the print surface after fusing and interferes with glue and adhesive performance.

Fuser oils are commonly used in connection with various conventional toners, which have limits on acceptable exposure to elevated temperatures and pressure due to the Tg's (glass transition temperatures) of the resins comprising the toner. Unfortunately, this discourages using prints based on conventional, ultra low melt toners for applications such as print-on-demand car manuals, a market share for high-end car manufacturers.

The use of low Tg materials in some recent printing systems helps lower the energy necessary to produce a print, given that the energy consumption of normal xerographic equipment is quite high. Thus, xerographic equipment with lower power consumption has been designed. Toners which are designed to function in the lower power consumption equipment, known as "low-melt toners" , are made to have softening points of about 45° C. to about 65° C. However, an image defect known as document offset (or "blocking") can occur at temperatures as low as about 45° C. to as high as about 70° C. or more when the toner begins to flow. Thus, low-melt toners often have a significant document offset problem. Document offset properties of various toners are set forth in Table 1.

TABLE 1

Comparison of Document Offset Properties of Various Low-Melt Toners

| Machine | Temperature* |
|---|---|
| DC2060 & DC12 | 62° C. (144° F.) |
| DC40 & Majestik ® (Xerox Corp.) | 61° C. (142° F.) |
| DT180 | 55.5° C. (132° F.) |
| iGen3 ® (Xerox Corp.) | 55.5° C. (132° F.) |

*where Document Offset (DO) = 4.0 @ 10 g/cm$^2$

As illustrated by Table 1, fused prints from these machines are limited to jobs that do not require the final product to be subjected to combinations of elevated temperature and pressure. This restriction is based upon the fact that the toner contains resins with characteristically low thermal glass transition temperatures, which when exceeded allow the resin to become amorphous and sticky. The stickiness of the toner results in prints that adhere to one another, either in an output tray or in the final product, and thus the prints become unusable. Unfortunately, the Tg's of these resins tend to be at or below temperatures that are easily achieved with day-to-day activities, such as car manuals in glove boxes.

In view of the energy consumption concerns mentioned above, there is a drive for toner to become ultra-low melt. Thus, the Tg's are anticipated to be lowered even more, which will result in even less robustness and image permanence under the above-mentioned environmental conditions.

Known methods of reducing document offset include adding wax to the toner itself (as in Emulsion Aggregation toner) and applying an overprint coating to the substrate. The overprint coating or varnish, either aqueous based or UV curable, is typically a liquid film coating that may be dried and/or cured. Drying may be accomplished through application of heat while curing may be accomplished by applying ultraviolet light or low voltage electron beams to polymerize (crosslink) the components of the overcoat. However, known overprint coatings, such as those described in U.S. Pat. Nos. 4,070,262; 4,071,425; 4,072,592; 4,072,770; 4,133,909; 5,162,389; 5,800,884; 4,265,976; and 5,219,641, for example, fail to adequately protect xerographic prints and fail to reduce document offset.

Additionally, the above described methods indicate that a coating may be applied to the surface of the substrate, with an image thereon, to cover the surface during a finishing step. The coating covers the entire surface of the substrate to protect the toner image from being rubbed from or scratched from the surface of the substrate. The coating may be a continuous dry film that is formed over the image and substrate. Digital Application of spot coating the image only component of the substrate is not possible due to the high viscosities of the coatings.

A problem observed with unfused toner images is that the output image receiving media exiting the marking module, where electrostatically charged toner particles are deposited on the substrate, must be very carefully handled because unfused toner is susceptible to distortion if subjected to any physical disturbance.

As used herein the term "unfused" is used to describe the condition of an output image receiving media or substrate to which an image forming substance, such as toner, has been applied in the formation of a copy of an original image. The unfused image may include text and/or graphics and the toner has not yet been fixed, generally by some form of heat and/or pressure fusing. The term "partial fusing" refers to a process of heating the toner to a temperature just below the melting point of the toner such that the toner becomes sticky and adheres to the substrate (no pressure is applied to congeal the toner particles together). A substrate with an "unfused" toner image is particularly susceptible to image degradation based on rubbing or smearing.

Because coatings of previous methods typically cover the entire surface of the substrate, the coating may often enhance the gloss of the surface, which may increase the visual appeal of the print or image, depending on the customers needs. If the coating is removed from the surface of the substrate, the continuous film formed by the coating may become non-uniform or non-continuous across the surface of the substrate. As a result, the coating removed from the surface may form one or more visual defects to the gloss or to the continuous film.

In addition, known coating formulations fail to prevent the formation of creasing or hairline cracks on the print surface in response to thermal expansion of the toner, which creates an undesirable appearance. This is a particularly important issue for automobile manuals, book covers, etc., which require the prints therein to survive high temperatures for hours at a time, yet retain a uniform appearance.

Therefore, a need exists for a system and a method for selectively protecting toner images on the surface of a substrate. Additionally, a need exists for a system and a method for protecting toner images with a coating which may increase the ability of the print to resist blocking, thereby improving the robustness of the print. Further, a need exists for a system and a method that applies heat and/or pressure to a partially fused image and coating for maintaining image integrity. Moreover, a need exists for a system and a method that provides a coating to minimize damaging effects to the final image caused by document offset or blocking.

Furthermore, a need exists for a protective coating composition that provides coating properties including, but not limited to: reduction or prevention of document offset, as well as protection of an image from sun, heat and smearing, particularly in commercial print applications.

SUMMARY

The present disclosure addresses the above concerns by the introduction of a wax-hybrid onto the print before the image is completely fixed. The presence of a wax-hybrid at this stage may present the opportunity to reduce the fuser oil rate (i.e., aid in fuser roll release if applied pre-fusing) and reduce document offset.

This application presents an inline system and method for forming a robust print via introduction of a wax-hybrid coating as a protective layer. This wax-hybrid print protection coating provides lubrication during the fusing process, thus possibly allowing for the reduction of fuser oil. Also, it provides a protective barrier that covers the toner image resulting in a print that is more robust to elevated temperatures and pressures.

The present disclosure provides protective coating compositions and methods for applying these protective coating compositions for electrostatographic prints. The compositions reduce document offset at temperatures up to, for example, at least about 70° C., such as from 70° C. to about 100° C.

The disclosure further relates to electrostatographic prints comprising a wax-hybrid composition applied to at least one surface of the print, such as applied to the top of a partially fused toner image. The wax-hybrid composition comprises a homogeneous mixture of at least a wax and a binder. By coating an electrostatographic print with the disclosed composition, the toner is effectively buried beneath an overcoat, which essentially forms a protective barrier on the print thus preventing undesirable offset.

In an embodiment, the present disclosure provides a method for protecting an image on a substrate, the method comprising:

forming an unfused toner image on a substrate, partially fusing the unfused toner image by heating the unfused toner image at a first temperature to form a partially fused toner image on the surface of the substrate, applying a coating to the partially fused toner image to form a coated and partially fused toner image on the surface of the substrate, and fusing the partially fused and coated toner image to form a final printed image.

In another embodiment the present disclosure provides for a system for protecting an image on a substrate, the system comprising:

a toner delivery station, wherein the toner from the toner delivery station is configured on a substrate to form an unfused toner image;

a station for partially fusing the toner image, wherein the unfused toner image is heated at a first temperature to form a partially fused toner image a coating station, wherein a coating from the coating station is applied to the partially fused toner image to form a coated and partially fused toner image, and a fusing station, wherein the coated and partially fused toner image is fused at a second temperature to form a final fixed image.

EMBODIMENTS

The present disclosure relates to a method for applying a coating over an image on a substrate.

In embodiments, provided is a method for protecting a print. The method includes applying a coating to a toner image on a substrate. Moreover, in embodiments the method includes a three-step process of fixing the toner on the surface of the substrate.

Figure 1:
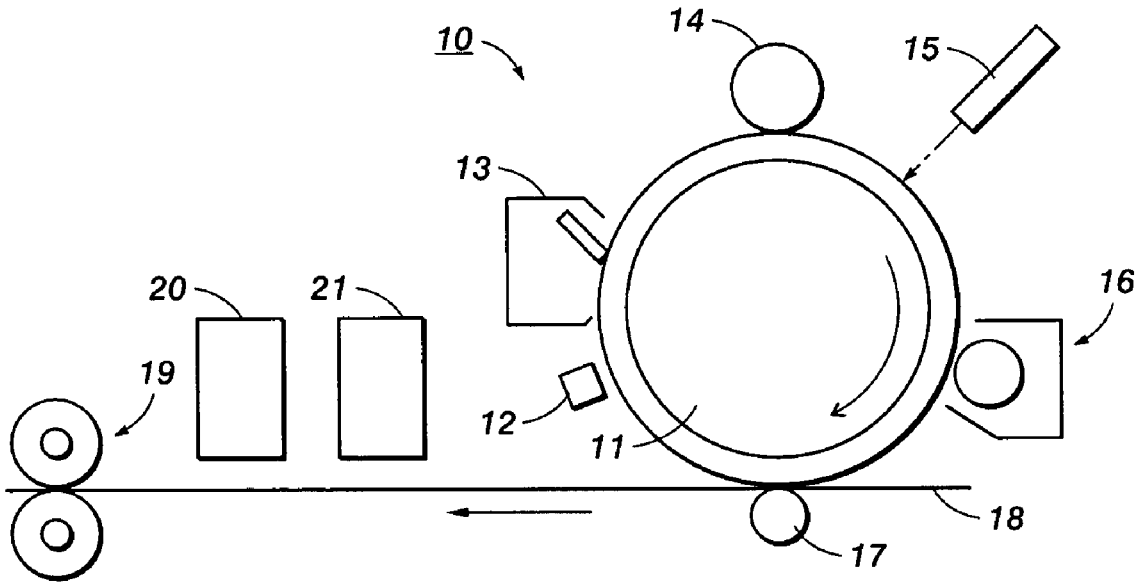
FIG. 1 is a schematic nonstructural view showing an embodiment of the electrophotographic image forming apparatus of the present disclosure.

FIG. 1 shows a schematic constitution of an embodiment of an image forming apparatus 10. The image forming apparatus 10 is equipped with an imaging member 11, such as a cylindrical photoreceptor drum, having a charge retentive surface to receive an electrostatic latent image thereon. Around the imaging member 11 may be disposed a static eliminating light source 12 for eliminating residual electrostatic charges on the imaging member 11, an optional cleaning blade 13 for removing the toner remained on the imaging member 11, a charging component 14, such as a charger roll, for charging the imaging member 11, a light-exposure laser optical system 15 for exposing the imaging member 11 based on an image signal, a development component 16 to apply developer material (toner) to the charge-retentive surface to create a developed image in the imaging member 11, and a transfer component 17, such as a transfer roll, to transfer a toner image from the imaging member 11 onto a copy substrate 18, such as paper, in this order. The image forming apparatus is equipped with a coating component 20 and partial fusing component 21. Also, the image forming apparatus 10 is equipped with a fusing component 19, such as a fuser/fixing roll, to fuse the toner image transferred onto the copy substrate 18 from the transfer component 17.

In embodiments, the method comprises forming an unfused toner image, partially fusing the unfused toner image at a first temperature, such as by exposing the composition to radiation, to prevent disruption of the image upon application of the wax hybrid composition to form a partially fused toner image, cooling the partially fused toner image to a second temperature, providing a protective coating composition comprising a wax-hybrid, applying the protective coating composition over the partially fused toner image, and fixing the protective coating composition and partially fused toner image to form a printed image. In embodiments, the protective coating composition is applied over the toner image by ink jet technology.

In embodiments, the method relates to a xerographic device comprising a toner image generating component and an ink jet device delivering a wax hybrid composition described herein. In this device, an image generating component can generate an image on a substrate. Thereafter, the ink jet device jets the wax hybrid composition over the partially fused toner image to form a protective coating.

In a particular embodiment, the method includes applying a coating to toner on the surface of a substrate, wherein the toner on the surface of the substrate is partially fused. Moreover, the method includes applying heat and pressure to the coating and the partially fused toner as it changes from the partially fused state to a permanently fixed image, wherein the toner in the fixed media forms the continuous image for the print and the interaction between the toner and coating prevents the toner or the coating from being removed from the surface of the substrate.

As used herein, "partially fusing" refers to a process of heating the toner to a temperature just below the melting point of the toner such that the toner becomes sticky and adheres to the substrate (no pressure applied to congeal the toner particles together). When the toner is cooled, the image will not be disrupted by subsequent coating. For example, the unfused toner image and substrate may be placed on a belt that passes under a heat source having a temperature of from about 50% to about 99% of the melting point, such as from about 60% to about 95% of the melting point or from about 70% to about 90% of the melting point.

As used herein, fusing describes a process occurring at temperatures greater than the melting temperature of the toner.

In embodiments, the substrate may be made from paper, such as coated paper stock, uncoated paper stock or any suitable coatable material. In embodiments, "substrate" may refer to or may include other substrates, such as transparencies, plastics and the like. In embodiments, the substrate may be fabricated with a pre-coating, such as a gloss that may cover a first side and/or a second side (collectively referred to hereinafter as "the sides") of the substrate. Toner may be applied to or may be printed onto one (simplex) or both (duplex) sides of the substrate to form an image on the sides of the substrate. In embodiments, the coating may be applied to or may cover the first side of the substrate to protect the image on the first side of the substrate. In embodiments, the coating may be applied to or may cover both of the sides of the substrate to protect a double-sided print having an image formed on each of the sides of the substrate. The coating may also cover only one or more portions of either side of the substrate.

In embodiments, the protective coating composition may be applied to any type of xerographic substrate, such as paper, wherein the substrate has a residue of fuser-oil (such as non-functionalized or functionalized silicone oil). The substrate can optionally contain additives including, but not limited to, anti-curl compounds, such as, for example, trimethylolpropane; biocides; humectants; chelating agents; and mixtures thereof; and any other optional additives well known in the xerographic art for enhancing the performance and/or value of the toner and/or substrate.

In embodiments the protective coating compositions may be applied over the entire surface of the image. Additionally, the protective coating compositions may be applied to a part of an image, that is, spot coating. For example, the protective coating composition can be applied over an entire surface of the printed substrate so as to provide ease of coating control, uniform gloss or appearance, and the like. Alternatively, the protective coating composition can be applied over only portions of the printed substrate, such as only over areas that have toner based images. In these latter embodiments, it is desired that the protective coating composition at least fully cover the printed image, although the protective coating composition can extend beyond the edges of the printing.

In embodiments, methods for generating toner images coated with the protective coating compositions disclosed herein generally comprise: generating an electrostatic latent image on a photoconductive imaging member, developing the latent image with toner, transferring the developed electrostatic image to a substrate, partially fusing the toner image to the substrate, coating the substrate or parts thereof and/or image or parts thereof with an overprint composition, and fixing or fusing the toner and wax-hybrid composition. Development of the image can be achieved by a number of methods known in the art, such as, for example, cascade, touchdown, powder cloud, magnetic brush, and the like. Transfer of the developed image to the substrate can be by any method, including, but not limited to, those making use of a corotron or a biased roll. The fixing step can be performed by means of any suitable method, such as, for example, flash fusing, heat fusing, pressure fusing, vapor fusing, and the like. Suitable imaging methods, devices, and systems are known in the art and include, but are not limited to, those described in U.S. Pat. Nos. 4,585,884, 4,584,253, 4,563,408, 4,265,990, 6,180,308, 6,212,347, 6,187,499, 5,966,570, 5,627,002, 5,366,840; 5,346,795, 5,223,368, and 5,826,147, the entire disclosures of which are incorporated herein by reference.

In embodiments, the protective coating compositions are wax-hybrid compositions. The wax-hybrid compositions are applied over toner based images and substrates that may have residual fuser oil present on the print. These residual oils may be silicone oils, such as polydimethylsiloxanes, and/or functionalized silicone oils, such as amino-functionalized PDMS oils and mercapto-functionalized PDMS oils. These residual oils may cover between 5% to 100% of the area of the toner-based image and substrate. These residual oils may cover the toner-based image and substrate at levels over from about 0 to about 50 $\mu g/cm^2$. The surface energy in areas covered by these residual oils may be as low as 15 mN/m.

However, the application of a protective coating composition on unfused toners, such as electrostatically charged toner particles deposited on an substrate, must be very carefully handled because unfused toner is susceptible to distortion if subjected to any physical disturbance. A substrate with an unfused toner image is particularly susceptible to image degradation based on forces due to smearing or rubbing. Therefore, a partial fusing step has been inserted to reduce the concerns with image distortion of the unfused toner image. During the partial fusing step the toner is heated to a temperature slightly below the melting point of the toner such that the toner becomes sticky and adheres to the substrate and, when the toner is cooled to room temperature, the image will not be disrupted by subsequent coating.

The energy source used to partially fuse the composition can be actinic, e.g., radiation having a wavelength in the ultraviolet or visible region of the spectrum, accelerated particles, e.g., electron beam radiation, thermal, e.g., heat or infrared radiation, or the like. In an embodiment, the energy is actinic radiation because such energy provides excellent control. Suitable sources of actinic radiation include, but are not limited to, mercury lamps, xenon lamps, carbon arc lamps, tungsten filament lamps, lasers, sunlight, and the like.

Infrared (IR) light, especially from Carbon based quartz lamps (Heraeus Quartz Light Inc.) with a high speed conveyor under IR, e.g., about 80 to about 130 ft/min., is particularly desirable, wherein the infrared is provided at a peak wavelength of about 2 microns for about 1 to about 2 seconds. More preferably, the speed of the high-speed conveyor is about 90 to about 120 ft/min. under infrared light at a wavelength of about 1.5 to about 4 um for about 1 to about 5 seconds. Optional equipment includes, but is not limited to, a reflector to focus or diffuse the infrared light, and a cooling system to remove heat from the infrared light source.

Generally, the wax-hybrid materials are a low viscosity, high melting point wax, such as a micro-crystalline or polymethylene based wax, coupled with a binding agent such as ethylene vinyl-acetate or a crystalline polyester resin. Generally, a binding agent is incorporated so that the thin wax layer stays put on the print after fusing. The ratio of wax to binder may be adjusted for a particular jetting viscosity and adherence to the print. With respect to viscosity, the components have radically different values; the waxes are generally at or below about 10 cP at 120° C. while the binding agent can be anywhere from about 600 cP to about 6,000 cP at 120° C. The viscosity of the finished material is maintained at or below about 20 cP at 120° C., specifically, about 16 cP at 120° C., more specifically about 12 cP at 120° C. to ensure consistent jetting.

Examples of waxes that can be selected for the wax-hybrid and used in the methods illustrated herein include, for example, polypropylenes and polyethylenes commercially available from, for example, Allied Chemical and Petrolite Corporation, wax emulsions available from, for example, Michaelman Inc. and the Daniels Products Company, EPOLENE N-15™ commercially available from, for example, Eastman Chemical Products, Inc., VISCOL 550-P™, a low weight average molecular weight polypropylene available from, for example, Sanyo Kasei K. K., and similar materials. The commercially available polyethylenes selected possess, it is believed, a weight average molecular weight $M_w$ of from about 500 to about 3,000, while the commercially available polypropylenes are believed to have a weight average molecular weight of from about 4,000 to about 7,000. Examples of functionalized waxes include amines and amides, for example, AQUA SUPERSLIP 6550™, SUPERSLIP 6530™ available from, for example, Micro Powder Inc., fluorinated waxes, such as POLYFLUO 190™, POLYFLUO 200™, POLYFLUO 523XF™, AQUA POLYFLUO 411™, AQUA POLYSILK 19™, POLYSILK 14™ available from, for example, Micro Powder Inc., mixed fluorinated amide waxes, such as MICROSPERSION 19™ available from, for example, Micro Powder Inc., imides, esters, quaternary amines, carboxylic acids or acrylic polymer emulsion, such as JONCRYL 74™, 89™, 130™, 537™, and 538™, are all available from, for example, SC Johnson Wax, chlorinated polypropylenes and polyethylenes available from, for example, Allied Chemical, Petrolite Corporation and SC Johnson Wax, and the like.

Illustrative examples of the binder may include a ethylene vinyl acetate resin. Additionally, crystalline polymer resins selected for the binder for the wax hybrid and used in the methods of the present disclosure include any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), or poly(octylene-adipate).

The crystalline resins, which are available from a number of sources, can possess various melting points of, for example, from about 30° C. to about 120° C., such as from about 50° C. to about 90° C. The crystalline resin may have, for example, a number average molecular weight (Mn), as measured by gel permeation chromatography (GPC) of, for example, from about 1,000 to about 50,000, and preferably from about 2,000 to about 25,000. The weight average molecular weight (Mw) of the resin may be, for example, from about 2,000 to about 100,000, such as from about 3,000 to about 80,000. The molecular weight distribution (Mw/Mn) of the crystalline resin is, for example, from about 2 to about 6, and more specifically, from about 2 to about 4.

The crystalline resins can be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9 nonediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, dodecanediocic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbometh-oxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

The viscosity of the protective coating compositions in embodiments can be, for example, from about 5 cP to about 15 cP, specifically from about 7 cP to about 12 cP at a temperature ranging from about 100° C. to about 140° C. such as about 110° C. to about 110° C.

In preparing the wax hybrid composition, the components can be mixed and combined together in any desired order and under any suitable conditions. For example, in embodiments, the components can be mixed together by first adding or mixing the wax, followed by addition and mixing of the binder. In between each addition, the composition can be stirred, as necessary, to ensure desired or full dissolution of each component. Other optional additives can also be added and mixed, as appropriate. For example, the components can be combined and mixed with brief agitation using, for example, a magnetic stir bar or overhead mixer between each addition until the components are dissolved. The formulation can be heated to reduce viscosity, if necessary. The resulting formulation may be filtered if necessary.

An example is set forth herein below and is illustrative of different compositions and conditions that can be utilized in practicing the disclosure. All proportions are by weight unless otherwise indicated. However, it will be apparent that the disclosure can be practiced with many types of compositions and can have many different uses in accordance with the disclosure above and as pointed out hereinafter.

EXAMPLES

Experimental materials were prepared by weighing out the appropriate amounts of a polymethylene based wax and ethylene vinyl-acetate resin (EVA) to obtain a ratio of about 84% wax to about 16% EVA on an analytical balance. The wax material was placed in an aluminum dish and heated to approximately 150° C. in order to melt the wax. Once melted, stirring was introduced and the binder was mixed in at 300 RPM. The mixture was allowed to stir for approximately five minutes and then was removed from the hot plate and allowed to cool to room temperature. The resulting mixture was measured for viscosity and then transferred to the piezo ink jet system. The finished material had a viscosity of about 12 cP at 120° C.

Figure 2:
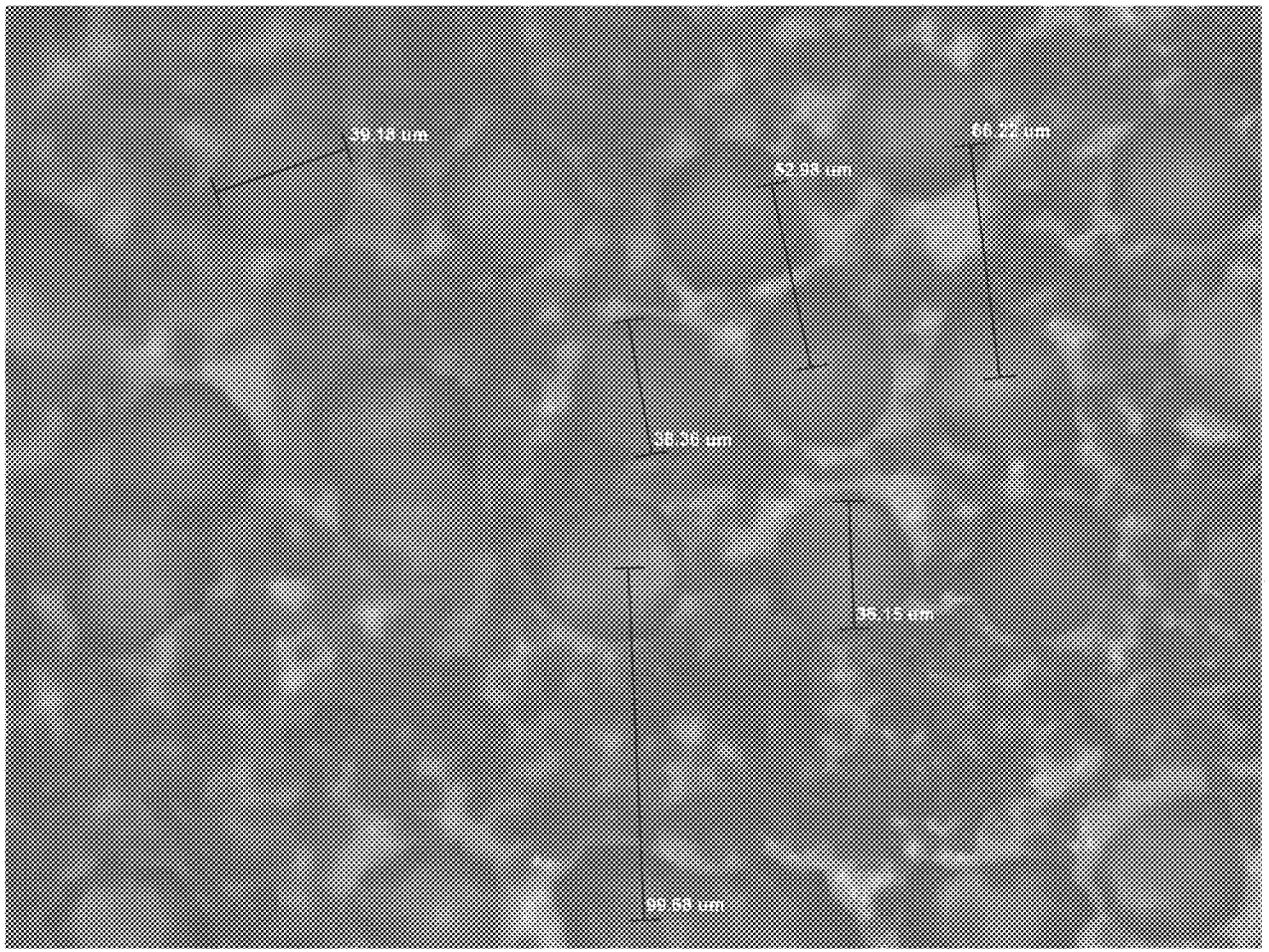
FIG. 2 is a is a photograph that shows a partially fused print with the wax-hybrid drops sitting on top of toner drops prior to fusing. Large objects (with scales) are wax-hybrid drops and smaller objects are partially fused toner particles.
Figure 3:
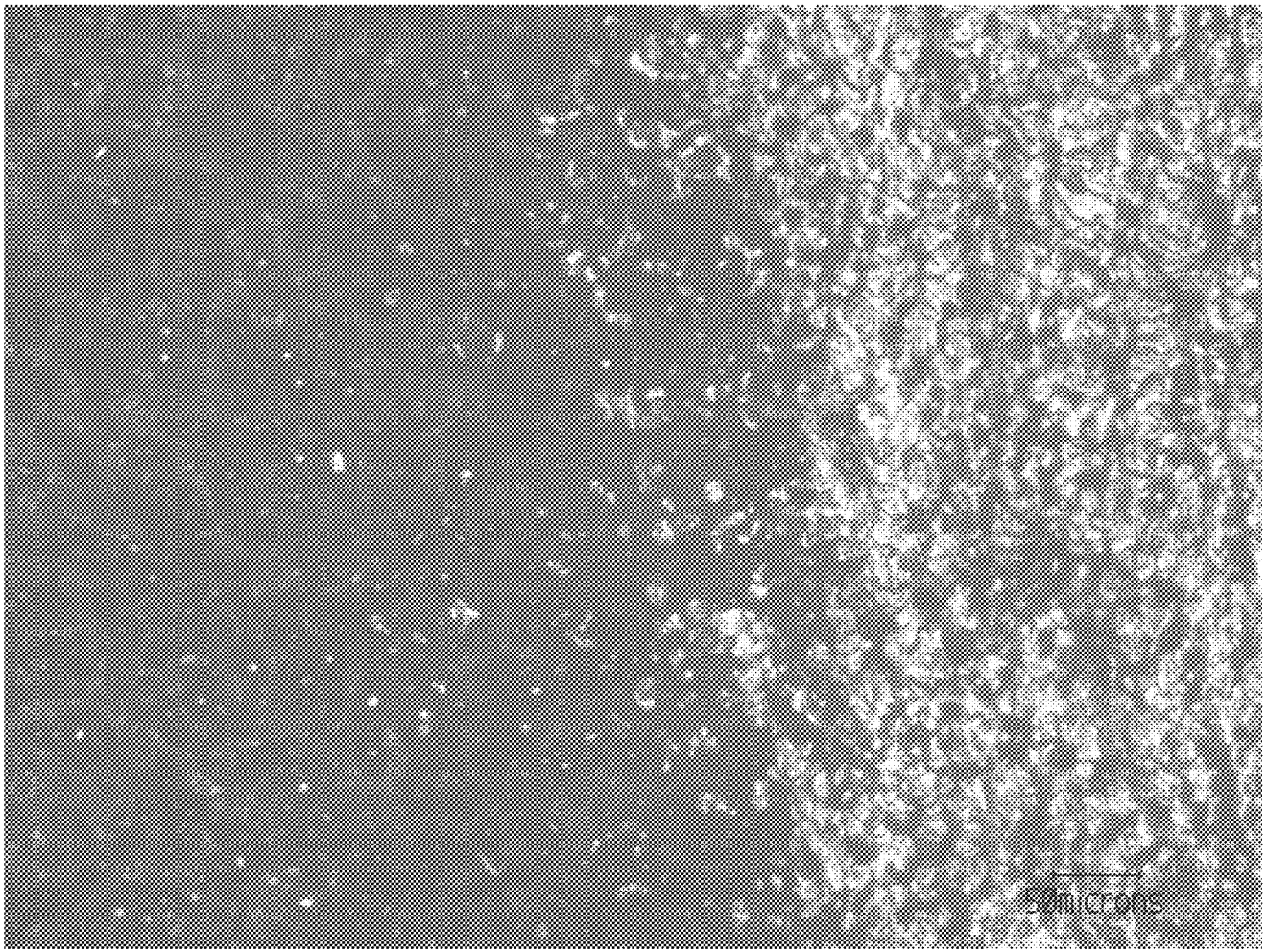
FIG. 3 is a photograph that shows a completely fused print partially covered with the wax-hybrid. Areas of the toner not covered by the wax hybrid appear lighter due to the reflective properties under the microscope.

Unfused images were made on a DC-12 machine using conventional toner. Only cyan images were made. Toner mass per unit area (TMA) was controlled to approximately 0.50 mg/copy and the fill pattern was 100%. Once the unfused images were made they were exposed to infrared light (Heraeus Quartz Light Inc, Carbon-based) by running the print on a belt at approximately 15 ft/min (a dwell time of 1-2 seconds). The resulting paper temperature was from about 140-150° C. Once heated, the partially fused print was returned to room temperature. Prints were then taped to a drum and the protective coating compositions were jetted at a frequency of 13-38 KHz to achieve a drop size of approximately 20-40 nanograms. FIG. 2 shows an image after the wax hybrid has been jetted and partially fused thereon. After the materials were jetted onto the partially fused print, the partially fused and coated print was run through an iGen3 fusing subsystem operating at 185° C. and a pressure load of 100 psi in order to smooth out the wax layer. FIG. 3 shows a portion of a completely fused image having part of the image covered in wax-hybrid and the other part without the wax hybrid. As apparent from FIG. 3, a fairly continuous film exists over top of the toner on the portions of the image where the wax-hybrid was applied.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A system for protecting an image on a substrate, the system comprising:

a toner delivery station, wherein the toner from the toner delivery station is configured on a substrate to form an unfused toner image;

a station for partially fusing a toner image, the station for partially fusing a toner image comprising an actinic radiation source configured to provide energy for partially fusing the toner image, the station for partially fusing a toner image configured to heat wherein the unfused toner image to a first temperature to form a partially fused toner image;

a coating station, configured to apply a coating comprising a wax-hybrid to the partially fused toner image to form a coated and partially fused toner image; and a fusing station configured to fuse the coated and partially fused toner image by heating to a second temperature and applying pressure to form a fixed image.

2. The system of claim 1, wherein fuser oil is present on the substrate.

3. The system of claim 1, wherein the wax-hybrid comprises a high melt wax and a binding agent.

4. The system of claim 3, wherein the binding agent is a crystalline polyester resin.

5. The system of claim 3, wherein the binding agent is an ethylene vinyl acetate resin.

6. The system of claim 3, wherein the wax hybrid has a viscosity less than about 12 cP at 120° C.

7. An image forming apparatus including therein the system of claim 1.

8. A method for protecting a print comprised of toner, the method comprising:

forming an unfused toner image on a substrate, partially fusing the unfused toner image by heating the unfused toner image at first temperature to form a partially fused toner image on the surface of the substrate, applying a wax-hybrid coating to the partially fused toner image on a surface of a substrate to form a coated and partially fused toner image on the surface of the substrate, and fixing the partially fused and coated toner image to form a printed image.

9. The method of claim 8, wherein the fixing of the partially fused and coated toner image comprises heating the coated and partially fused toner image at a second temperature, wherein the heating step uses the wax-hybrid to form a protective barrier over the fixed toner image.

10. The method of claim 8, wherein the fixing comprises applying heat and pressure to the coated and partially fused toner image on the surface of the substrate.

11. The method of claim 8, wherein the wax-hybrid comprises a high melt wax and a binding agent.

12. The method of claim 11, wherein the binding agent is a crystalline polyester resin.

13. The method of claim 11, wherein the binding agent is an ethylene vinyl acetate resin.

14. The method of claim 11, wherein the wax-hybrid has a viscosity less than about 12 cP at 120° C.

15. The method of claim 8, wherein fuser oil is present on the substrate.

16. The method of claim 15, wherein the fuser oil is amino functionalized silicone oil.

17. The method of claim 8, wherein the unfused toner image is heated by an actinic radiation source.

18. The method of claim 17, wherein the actinic radiation source is a carbon based infrared radiation source.

19. The method of claim 8, further comprising:

cooling the partially fused toner image.

* * * * *